US006980760B2

(12) United States Patent
Okamoto et al.

(10) Patent No.: US 6,980,760 B2
(45) Date of Patent: Dec. 27, 2005

(54) IMAGE FORMING APPARATUS AND HOLDING METHOD OF IMAGE CARRIER

(75) Inventors: Masaya Okamoto, Saitama (JP); Keiji Sasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/629,619

(22) Filed: Jul. 30, 2003

(65) Prior Publication Data

US 2004/0114962 A1 Jun. 17, 2004

(30) Foreign Application Priority Data

Dec. 16, 2002 (JP) ..... P2002-364484

(51) Int. Cl.[7] ..... G03G 15/01
(52) U.S. Cl. ..... 399/227; 399/302
(58) Field of Search ..... 399/222, 223, 399/226, 227, 228, 298, 302, 308, 312, 313

(56) References Cited

U.S. PATENT DOCUMENTS 5,585,598 A * 12/1996 Kasahara et al. ..... 399/227
6,072,976 A * 6/2000 Kuriyama et al. ..... 399/302
6,445,900 B2 * 9/2002 Fukao et al. ..... 399/302
6,535,705 B2 * 3/2003 Asakura et al. ..... 399/227 X
6,535,707 B2 * 3/2003 Maruta et al. ..... 399/227
6,625,410 B2 * 9/2003 Sato et al. ..... 399/302 X
6,701,100 B2 * 3/2004 Tamiya et al. ..... 399/302 X
6,760,564 B2 * 7/2004 Oohara et al. ..... 399/302

FOREIGN PATENT DOCUMENTS

JP 2001-1183902 7/2001

* cited by examiner

*Primary Examiner*—Sandra L. Brase
(74) *Attorney, Agent, or Firm*—Morgan, Lewis & Bockius LLP

(57) ABSTRACT

An image forming apparatus is included of a pivotally rotated photosensitive drum, a developing roller for developing an electrostatic latent image formed on this photosensitive drum, and an intermediate transfer belt for temporarily holding the toner image which has been developed to be formed by the developing roller. This developing roller is equipped with a tracking roller which abuts against the photosensitive drum so as to keep a distance between the developing roller and the photosensitive drum as a constant distance. A direction of weight "a" produced by this tracking roller with respect to the photosensitive drum may be positioned within a so-called "wrap range" corresponding to an abutting range between the intermediate transfer belt and the photosensitive drum.

27 Claims, 6 Drawing Sheets

IMAGE FORMING APPARATUS AND HOLDING METHOD OF IMAGE CARRIER

CROSS REFERENCE OF RELATED APPLICATION

This application is based on and claims priority under 35 U.S.C. § 119 with respect to Japanese Patent Application No. 2002-364484 filed on Dec. 16, 2002, the entire content of which is incorporated herein by reference.

BACKGROUND OF THE INVENTION

1. Field of the Invention

The present invention relates to image forming apparatus such as printers, copying machines, and facsimile apparatus. More specifically, the present invention is directed to image forming apparatus equipped with a member for abutting against image carriers.

2. Description of the Related Art

In image forming apparatus using an electrophotographic system such as printers, copying machines, and facsimile apparatus, image forming operations are carried out as follows. That is, after latent images are acquired by latent image forming unit in such a manner that light is irradiated onto image carriers such as photosensitive drums which have been uniformly charged, toners are applied to the charged latent images by developing unit so as to produce visible images. Then, for example, a plurality of toner images are transferred to intermediate transfer members in a multiple mode, and thereafter, these multiple toner images are transferred onto recording papers so as to be fixed thereon.

As a developing unit of this image forming apparatus, recently, a rotary type developing apparatus has been provided in which four sets of color developing devices (yellow, magenta, cyan, and black developing devices) are held in the vicinity of a single image carrier along a circumferential direction of a rotary member. In the case that this rotary type developing apparatus is employed, when a desirable developing device is moved to a developing position opposite to the image carrier, an interval between the image carrier and a developing agent carrier such as a developing roller employed in this desirable developing device must be kept constant.

To this end, in a conventional image forming apparatus, while tracking rollers are provided on both coaxial edge portions of a developing roller in each of developing devices and the tracking rollers correspond to such a positioning member capable of holding an interval between a photosensitive drum (image carrier) and an developing roller (developing agent carrier), these tracking rollers are caused to abut (is contacted to) the photosensitive drum so as to perform positioning of the developing device, so that the interval between the photosensitive drum and the developing roller can be made constant as described in JP-A-2001-183902.

In this technique, for example, since a photosensitive drum is pivotally rotated around a shaft as a center, respective image forming processes constructed of a charging process, an exposing process, a developing process, and a transferring (primary transferring) process are carried out. If the respective apparatuses for executing these image forming processes are made in no contact with respect to this photosensitive drum, then the pivotal rotation of this photosensitive drum may be controlled based upon only variable elements of the photosensitive drum. However, even in such a case that, for instance, a developing device for forming a single color image is employed in addition to such a tracking roller as described in the above-explained patent publication, when an abutting function is provided in which a predetermined member abuts against a photosensitive drum due to a predetermined positioning aspect, the following problem may occur. That is, weight produced when these members abut against the photosensitive drum may cause such a problem with respect to this photosensitive drum. This contact (abutting) problem with respect to an image carrier such as a photosensitive drum may similarly occur even in the case that a transfer apparatus such as a transfer belt which abuts against this image carrier is employed.

When these abutting members are strongly depressed with respect to the image carrier such as the photosensitive drum, there are some possibilities that the shaft of the photosensitive drum is bent due to the weight of these abutting members, and thus, this shaft bending phenomenon may cause disturbances of images, for instance, color shifts, or color deviation. This bending phenomenon may give an adverse influence to holding characteristics of the photosensitive drum, and further, this weight may give an adverse influence to such a phenomenon that the shaft of the photosensitive drum is bent in accordance with a time elapse. This problem may be conspicuously emphasized in such a case that a diameter of a drum shaft is made narrower due to a cost-down reason and/or light weight of an image forming apparatus. More specifically, in the case that such a drum holding structure that one shaft is penetrated is not employed, but a photosensitive drum is supported by two shafts (namely, cantilever shafts) which are projected from both ends of this photosensitive drum in a half way, since these cantilevers own deteriorated stabilities, abutting weight given to the photosensitive drum may readily give an adverse influence to a holding characteristic of this photosensitive drum by this shaft. Also, it is easily predictable that variations may be considerably increased due to shifts of a center shaft of this photosensitive drum.

Also, for instance, as in a rotary type developing apparatus, in the case that a member abuts against an image carrier (e.g., photosensitive drum and photosensitive belt) at predetermined timing, when this member is advanced (abuts) and is retracted (separated) to/from this image carrier, shocks and vibrations may occur. These shocks and vibrations are transferred to, for example, a primary transferring unit, a secondary transferring unit, and an exposing unit, so that disturbances of images may readily occur. An image forming apparatus may be constituted in such a manner that while timing of an image forming operation is adjusted, for instance, a tracking roller of a developing apparatus abuts against an image carrier at such a timing that no exposing operation is carried out. However, for example, in the case that a diameter of a photosensitive drum is decreased, or a length of a photosensitive belt is shortened, and thus, respective apparatuses capable of performing respective image forming processes are arranged in the vicinity of these apparatuses, for instance, even when upset exposing timing, transferring timing cannot be displaced. As a result, as to shocks and vibrations caused by abutting operation of members, disturbances of images could not sufficiently suppressed in these conventional image forming apparatuses

SUMMARY OF THE INVENTION

The present invention has been made to solve the above-explained technical problems, and therefore, has an object to provide an image forming apparatus capable of suppressing image disturbances produced when images are formed with employment of an image carrier, while a member abutting with respect to this image carrier is positively utilized.

Another object of the present invention is to provide such an image forming apparatus capable of mitigating image disturbances caused by shocks and vibrations when a contact member abuts with respect to an image carrier.

A further object of the present invention is to provide an image forming apparatus capable of suppressing a bending phenomenon of a shaft and the like, which support an image carrier even when a member for abutting against the image carrier is employed.

To achieve the above-described objects, an image forming apparatus, to which the present invention is applied, employs, for example, a developing agent carrier for developing an electrostatic latent image formed on an image carrier, and also, a first contacting unit corresponding to a member capable of maintaining a distance between the image carrier and the developing agent carrier. This first contacting unit is contacted to the image carrier along a predetermined weight direction. Also, while a second contacting unit is employed, this second contacting unit is contacted with respect to the image carrier in a wrap shape. The second contacting unit corresponds to, for example, an elastic belt which is followed by receiving driving force of the image carrier. The predetermined weight direction by this first contacting unit is intersected with the wrap-shaped contact range by the second contacting unit.

In this case, the image forming apparatus is featured by that this first contacting unit is provided in a developing device in which a plurality of these developing agent carriers are provided on a circumference thereof, and is a tracking member capable of maintaining the distance between a specific developing agent carrier and the image carrier when the developing device is pivotally rotated and thus the specific developing agent carrier is located opposite to the image carrier. Also, when it is so featured that this second contacting unit is provided at such a position which is eccentrically located on the downstream side of the pivotal rotation direction of the image carrier with respect to the first contacting unit, for instance, even in such a case that the first contacting unit is pivotally rotated to abut against the image carrier, disturbances of images caused by shocks and vibrations can be preferably mitigated.

On the other hand, an image forming apparatus, to which the present invention is applied, is featured by including: an image carrier corresponding to, for instance, a photosensitive drum having an axial center; a developing device for developing an electrostatic latent image formed on the image carrier; and an intermediate transfer member for abutting against the image carrier so as to temporarily hold thereon a toner image formed by being developed by the developing device; in which the developing device is included of a positioning member which abuts against the image carrier; and a weight direction by the positioning member to the image carrier is located within an abutting range between the intermediate transfer member and the image carrier.

In this image forming apparatus, this intermediate transfer member is made of an elastic belt, and abuts with respect to the image carrier under such a condition that the image carrier is wrapped only over a predetermined range by the intermediate transfer member. Also, it is so featured that the intermediate transfer member is followed by receiving driving force produced from the image carrier. Further, it is so featured that the developing device holds a plurality of developing agent carriers along a circumferential direction thereof, and is pivotally rotated in such a manner that a desirable developing agent carrier among the plural developing agent carriers is transported to a developing position located opposite to the image carrier. Still further, it is so featured that the positioning member employed in the developing device is a tracking member capable of maintaining an interval between each of the developing agent carriers and the image carrier in a constant value.

According to another aspect of the present invention, an image forming apparatus, to which the present invention is applied, is featured by that this image forming apparatus owns such a portion that both a straight line and a weight direction of the developing device with respect to the image carrier become a substantially straight line, while the straight line connects a contact point of the intermediate transfer member to the image carrier to a center of the image carrier. This intermediate transfer member is made of an elastic belt, and is contacted to the image carrier via either a line or a plane. Also, the developing device is contacted to the image carrier at a preselected portion in order to keep a distance of the own developing device located opposite to the image carrier constant.

In addition, an image forming apparatus, to which the present invention is applied, is featured by that while an electrostatic image is formed on an image carrier by an electrostatic latent image forming unit, this image forming apparatus is included of: developing unit in which a plurality of developing rollers are provided along a circumferential direction thereof in order to develop the electrostatic latent image formed by the electrostatic latent image forming unit to thereby form a toner image, and a desirable developing roller is transported to a developing position located opposite to the image carrier; and transferring unit which abuts against the image carrier in a wrap shape, and temporarily holds thereon the toner image formed on the image carrier; in which an extension of a line which connects a center of the image carrier to a center of the desirable developing roller located opposite to the image carrier is positioned within a range where the transferring unit abuts against the image carrier in a wrap shape.

In this case, this developing unit employs a member capable of maintaining an interval between the developing agent carrier and the image carrier in a constant value in correspondence with each of the developing agent carriers. Also, this member employed in the developing unit depresses the image carrier along a predetermined direction when positioning of the developing agent carrier for executing the developing operation is carried out with respect to the image carrier.

According to a further aspect of the present invention, an image forming apparatus, to which the present invention is applied, is featured by that in the developing unit, when the desirable developing agent carrier is pivotally rotated to the developing position, a predetermined member abuts against the image carrier via a predetermined trail; and a direction along which the predetermined member depresses the image carrier via the trail is located within a range where the transferring unit abuts against the image carrier in a wrap shape. In this case, this predetermined member is a tracking roller which abuts against the image carrier within a non-developing range, and determines an interval between the image carrier and the developing agent carrier. Furthermore, this predetermined member is provided in correspondence with all of the developing agent carriers provided in the developing unit; and when each of the developing agent carriers is located opposite to the image carrier, a direction along which the predetermined member depresses against the image carrier is located within the range where the transferring unit abuts against the image carrier in the wrap shape.

Also, an image forming apparatus, to which the present invention is applied, is featured by including: developing unit in which a plurality of developing agent carriers are provided along a circumferential direction thereof in order to develop the electrostatic latent image formed by the electrostatic latent image forming unit to thereby form a toner image, and a desirable developing agent carrier is pivotally rotated to a developing position located opposite to the image carrier; and transferring unit which abuts against the image carrier in a wrap shape, and temporarily holds thereon the toner image formed on the image carrier; in which in the developing unit, when the desirable developing agent carrier is separated from the developing position, a predetermined member is separated from the image carrier via a predetermined trail; and a direction along which the predetermined member depresses the image carrier via the trail is located within a range where the transferring unit abuts against the image carrier in a wrap shape.

On the other hand, a method of holding an image carrier, to which the present invention is applied, is featured by including: a step for abutting with respect to a pivotally rotated image carrier along a predetermined direction so as to depress the image carrier; a step for depressing the image carrier via a center shaft of the image carrier in predetermined weight along a direction opposite to the predetermined direction; and a step for stably holding the image carrier based upon both the depression made along the predetermined direction and the depression made along the direction opposite to the predetermined direction. This depression along the predetermined direction is realized by abutting with respect to the image carrier from a circumferential portion of the image carrier in a wrap shape within a predetermined range so as to depress the image carrier. Also, it is so featured that the opposite direction corresponds to such a direction along which the depression is made from the circumferential portion toward the center shaft within a range at the circumferential portion of the image carrier, which is formed by an extension of such a straight line passing through the abutting range in the wrap shape and the center shaft.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Referring now to attached drawings, various embodiment modes of the present invention will be described.

Figure 1:
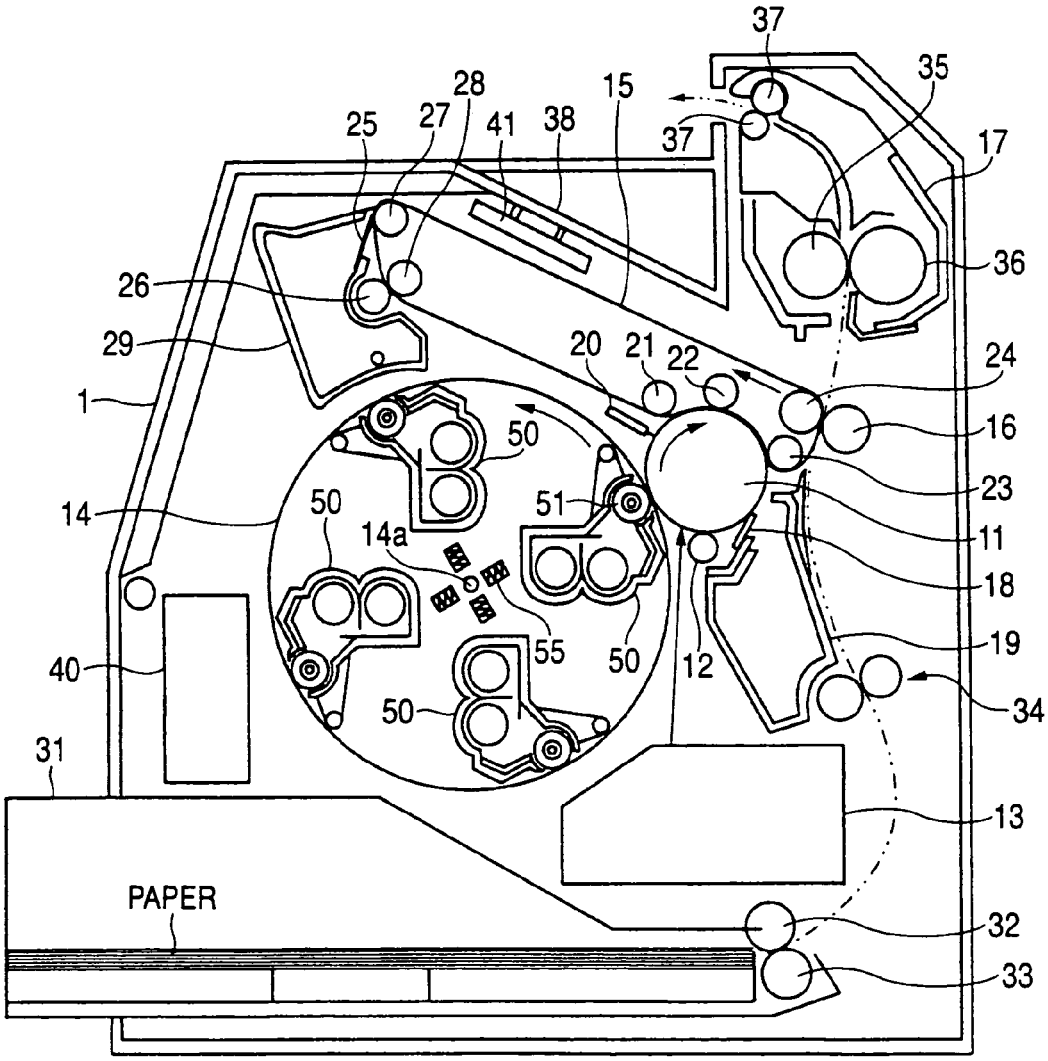
FIG. 1 is a diagram for indicating an entire arrangement of an image forming apparatus to which an embodiment of the present invention is applied.

FIG. 1 is a diagram for indicating an entire structure of an image forming apparatus to which an embodiment mode of the present invention may be applied. This drawing shows a digital color printer with employment of a rotary type developing apparatus. In the image forming apparatus shown in FIG. 1, a main body 1 of this image forming apparatus is provided with a photosensitive drum 11, a charging device 12, an exposing apparatus 13, and a developing apparatus 14. The photosensitive drum 11 corresponds to an image carrier which forms an electrostatic latent image to carry thereon a toner image. The charging device 12 applies electron charges to the photosensitive drum 11 so as to charge this photosensitive drum 11 by employing a charge roller and the like. The exposing apparatus 13 is operated in such a manner that the charged photosensitive drum 11 is exposed in an exposing unit by employing, for example, an ROS (Raster Output Scanner) in response to an image signal supplied from an image processing apparatus (IPS) which is not shown in this drawing. The developing apparatus 14 develops the electrostatic image which has been formed on the photosensitive drum 11 by the exposing apparatus 13 so as to form a toner image.

This developing apparatus 14 corresponds to the rotary type developing apparatus, and is provided with four developing devices 50. The four developing devices 50 contain four color toners in order to produce four color toner images, namely a yellow (Y)-color toner image, a magenta (M)-color toner image, a cyan (C)-color toner image, and a black (K)-color toner image. A developing roller 51 is provided on a circumference of the developing apparatus 14. The developing roller 51 corresponds to a developing agent carrier, which may develop latent images formed on the photosensitive drum 11. Since the developing apparatus 14 is pivotally rotated at a rotation angle of 90 degrees while a developing apparatus center 14*a* is set as a center, the developing roller 51 equipped by the desirable developing device 50 may be located opposite to the photosensitive drum 11. Concretely speaking, with respect to one color print output, the respective color (Y, M, C, K) developing devices 50 are located opposite to the photosensitive drum 11 in this color order, so that a full-color print output may be produced. Also, these developing devices 50 are arranged in such a manner that these developing devices 50 are depressed on a normal by plural coil springs 55 positioned on the developing apparatus center 14*a*, a tracking roller (will be explained later) used in positioning operation can surely abut against the photosensitive drum 11. The photosensitive drum 11 is pivotally rotated along an arrow direction (namely, clockwise direction) shown in this drawing, whereas the developing apparatus 14 is pivotally rotated along a counter-clockwise direction in order that the pivotal rotation (along clockwise direction) of the photosensitive drum 11 becomes equal to movement along the tangential direction. Since the pivotal rotation of the photosensitive drum 11 is made coincident with the movement along the tangential direction, the shocks given to this photosensitive drum 11 can be reduced in the case that the tracking roller is made in contact with this photosensitive drum 11 while having a predetermined trail.

Also, on a downstream side of the developing apparatus 14 over the photosensitive drum 11, there are provided with an intermediate transfer belt 15 corresponding to an intermediate transfer member, a secondary transfer roller 16 corresponding to a secondary transfer member, and a fixing apparatus 17. The intermediate transfer belt 15 temporarily holds thereon a toner image which has been developed by the developing device 50 to be formed on the photosensitive drum 11. The secondary transfer roller 16 transfers a toner image to a recording paper, and this toner image has been formed by superimposing a plurality of color toner images on the intermediate transfer belt 15. The fixing apparatus 17 heats and depresses the toner image formed on the paper so as to fix this toner image on this paper. Furthermore, a cleaning blade 18 and a toner collecting bottle 19 are provided around the photosensitive drum 11. The cleaning blade 18 scrapes toners (residual toners) left on the photosensitive drum 11 after toner images have been transferred onto the intermediate transfer belt 15 in the primary transfer mode. The toner collecting bottle 19 stores thereinto the toners scraped by this cleaning blade 18 in order to collect these scraped toners. Also, a density sensor 20 is provided between the developing apparatus 14 and the intermediate transfer belt 15. This density sensor 20 corresponds to a reflection type sensor used to measure density (concentration) of toners supplied from the developing device 50. The intermediate transfer belt 15 is rotated 4 times while one print image is produced. The secondary transfer roller 16 is arranged as follows. That is, this secondary transfer roller 16 is retracted (separated) from this intermediate transfer belt 15 while the intermediate transfer belt 15 is rotated during first three rotations. When a last color (K) toner image is superimposed on these color toner images, the secondary transfer roller 16 may be made in contact with the intermediate transfer belt 15.

The intermediate transfer belt 15 is contacted (abuts) in a wrap shape with respect to the photosensitive drum 11 in such a manner that this intermediate transfer belt 15 wraps the photosensitive drum 11 only over a predetermined range, and therefore, a so-called "wrap transfer" can be realized. This intermediate transfer belt 15 has a thickness of, for example, approximately 0.5 mm, and a circumferential length of 443 mm. As a material of this intermediate transfer belt 15, chloroprene having a superior oil resisting characteristic and also a superior anti-seasoning characteristic, EPDM having a superior anti-seasoning characteristic, and the like are employed. In this embodiment, while a drive source is not provided with the intermediate transfer belt 15 itself, this intermediate transfer belt 15 may follow rotations of the photosensitive drum 11 by utilizing contacts made by the wrapping effect. This intermediate transfer belt 15 is pivotally rotated along the counter-clockwise direction in order that the rotation direction of the contact portion thereof is made coincident with that of the photosensitive drum 11.

A wrap-in roller 21, a primary transfer roller 22, and a wrap-out roller 23 are provided inside this intermediate transfer belt 15. The wrap-in roller 21 specifies a wrap position of the intermediate transfer belt 15 on the side of an upper stream in the rotation of the photosensitive drum 11. The primary transfer roller 22 transfers a toner image formed on the photosensitive drum 11 onto the intermediate transfer belt 15. The wrap-out roller 23 specifies a wrap position of the intermediate transfer belt 15 on the side of a down stream of the the wrap position. A predetermined electric field is being applied to the primary transfer roller 22 in order to support the primary transfer operation. On the other hand, both the wrap-in roller 21 and the wrap-out roller 23 are brought into either a GND (ground) potential state, or a floating state.

Also, a back-up roller 24 for supporting a secondary transfer operation by the secondary transfer roller 16 is provided inside the intermediate transfer belt 15. In a secondary transferring unit in which the secondary transferring operation is carried out by both the secondary transfer roller 16 and the back-up roller 24, a predetermined potential difference is required between this back-up roller 24 and the secondary transfer roller 16. In such a case that one roller, for example, the secondary transfer roller 16 is connected to a high potential source, the other roller, namely, the back-up roller 24 is connected to the GND potential.

In a down stream of a secondary transferring unit on the intermediate transfer belt 15, there are provided with a scraper 25, a cleaning back-up roller 27, a brush roller 26, another cleaning back-up roller 28, and a second toner collecting bottle 29. The scraper 25 scrapes remaining toners after the secondary transferring operation. The cleaning back-up roller 27 assists the cleaning work effected by this scraper 25. The brush roller 26 further scrapes such toners which have been left after the cleaning operation by the scraper 25 is accomplished. The cleaning back-up roller 28 assists the cleaning work effected by the brush roller 26. The second toner collecting bottle 29 collects the toners which have been scraped by both the scraper 25 and the brush roller 26. The scraper 25 is made of a thin metal plate having a thickness of approximately 0.1 mm, for example, a stainless steel, to which a predetermined electric field is being applied. The brush roller 26 corresponds to a nylon (polyamide) brush, or an acrylic brush, which have been processed as to conductivity thereof. This brush roller 26 is rotated by receiving power supplied from a drive source, and then, scraped toners are stored from a window formed in the second toner collecting bottle 29 into the internal area of this second toner collecting bottle 29. Both the scraper 25 and the brush roller 26 may scrape toners lefted on the intermediate transfer belt 15 after the secondary transfer roller 16 has performed the secondary transferring operation by being made in contact to the intermediate transfer belt 15. To secure this scraping operation, both the scraper 25 and the brush roller 26 are arranged in such a manner that in the first stage of the image forming operation, both the scraper 25 and the brush roller 26 are retracted from the intermediate transfer belt 15 in order that toner images under superimposing operation are not scraped, and these scraper 25 and brush roller 26 are contacted to the intermediate transfer belt 15 in an integral form.

As a paper transporting system, this image forming apparatus is equipped with a paper supply cassette 31, a feed roller 32, a retard roller 33, a register roller 34, a heat roller 35, a pressure roller 36, an eject roller 37, and an eject tray 38. The paper supply cassette 31 stores thereinto papers. The feed roller 32 feeds out papers from this paper supply cassette 31 to supply these fed papers. The retard roller 33 sorts supplied papers every 1 sheet. The register roller 34 adjusts (registers) transfer timing with respect to a paper which is transported for the paper supply cassette 31 via the feed roller 32 and the like. The heat roller 35 is provided within the fixing apparatus 17, and heats a toner image formed on a paper. The pressure roller 36 is provided opposite to the heat roller 35, and depresses a paper when being heated by the heat roller 35. The eject roller 37 ejects a copy paper out of the image forming apparatus after fixing operation. The eject tray 30 stores thereinto a paper ejected from the eject roller 37.

Furthermore, the image forming apparatus is provided with a control unit 40 and a position sensor 41. The control unit 40 controls entire operations of this image forming apparatus. The position sensor 41 corresponds to a reflection type photosensor, and is provided adjacent to the intermediate transfer belt 15. This position sensor 41 senses a patch of a toner, which is formed on the intermediate transfer belt 15. Since this position sensor 41 reads out the patch which is formed on the intermediate transfer belt 15 along the longitudinal direction, this position sensor 41 can detect a position of the intermediate transfer belt 15 along a rotation direction. Concretely speaking, since an exposing operation is carried out at preselected timing after such a position that the patch has been detected by the position sensor 41, positioning (registering) operations of the respective colors Y, M, C, K can be carried out. Also, while density of a toner formed on the intermediate transfer belt 15 is sensed based upon a sensor output of this position sensor 41, a density control operation may be carried out by the control unit 40 based on this density sensing result.

Next, a description will now be made of an image forming process operation with employment of the image forming apparatus shown in FIG. 1. In the image forming apparatus, upon receipt of an output request issued from either a PC (personal computer) or an image reading apparatus, which are externally connected to this image forming apparatus, an image forming process is commenced based upon an instruction sent from the control unit 40. In the case that a full-color print is outputted, in the developing apparatus 14, the yellow (Y)-color developing device 50 is pivotally rotated so as to be located opposite to the photosensitive drum 11. When a yellow (Y)-color toner image is firstly formed, the photosensitive drum 11 pivotally rotated along the clockwise direction is charged by the charging device 12 in the charging unit corresponding to the electron charge forming process. Thereafter, an exposing operation is carried out based upon image information corresponding to the yellow color, so that an electrostatic latent image is formed by the exposing apparatus 13. Thereafter, after the developing operation is carried out by the developing roller 51, an yellow (Y)-color toner image is transferred onto the intermediate transfer belt 15 in the wrap-shaped contact range (wrap range). At this time, while the secondary transfer roller 16, the scraper 25, and the brush roller 26 are retracted (separated) from the intermediate transfer belt 15, this yellow-color toner image transferred onto the intermediate transfer belt 15 is not scraped by these structural members.

On the surface of the photosensitive drum 11 after the primary transfer operation has been accomplished, the toners left on this surface is scraped by the cleaning blade 18, and then, this cleaned surface of the photosensitive drum 11 is moved to the charging unit by the charging device 12 in order to form the next toner image. Then, the developing apparatus 14 is pivotally rotated so as to be fitted to the developing timing, so that the magenta (M)-color developing device 50 is located opposite to the photosensitive drum 11, and a magenta (M)-color toner image is formed, and then, this magenta toner image is superimposed onto the intermediate transfer belt 15. Similarly, a cyan (C)-color toner image, and a black (K)-color toner image are sequentially superimposed on the intermediate transfer belt 15, so that the primary transferring operation is accomplished. The secondary transfer roller 16 is advanced (contacted) with respect to the intermediate transfer belt 15 after the primary transfer operation with respect to the cyan-color toner image exposed by the exposing apparatus 13 has been accomplished and before an exposing operation (exposing operation of black image) used to form a black latent image by the exposing apparatus 13 is commenced at an interimage produced after the toner image on which the three colors until the cyan color have been superimposed has passed through a secondary transferring unit (namely, place where secondary transferring operation is carried out by secondary transfer roller 16). Then, the image forming apparatus is prepared for a secondary transferring operation. Also, both the scraper 25 and the brush roller 26 are advanced with respect to the intermediate transfer belt 15 after the exposing operation of the black latent image has been accomplished when the cleaner unit (namely, place where cleaning operation is carried out by scraper 25 and brush roller 26) is an interimage. This interimage corresponds to such an area portion, in which a toner image is not formed. For example, when the intermediate transfer belt 15 having such a circumferential length of 443 mm, this interimage becomes 443-297=146 mm in the case that an image having a longitudinal A4-size of 297 mm is formed. It should be noted that the above-described advance timing of the secondary transfer roller 16 is determined based upon a maximum print size available from an image forming apparatus.

On the other hand, recording papers are successively derived from the paper supply cassette 31 by driving the feed roller 32 at preselected timing under control of the control unit 40, and these derived papers are sorted every one sheet by the retard roller 33, and then, the sorted paper is reached to the register roller 34. This register roller 34 owns such a function that the register roller 34 is rotated at the timing of the secondary transferring operation in the secondary transferring unit so as to feed out the recording paper at predetermined timing to the secondary transferring unit. In this embodiment, since the surface of the toner collecting bottle 19 is employed as the paper transport path, the paper is transported by utilizing this paper transport path.

The paper to which the toner image has been transferred in the secondary transferring unit is transported to the fixing apparatus 17. In this fixing apparatus 17, the toner image transferred onto the paper is heated by the heat roller 35, and depressed to this paper by the pressure roller 36, and thus, is fixed. Thereafter, this paper on which the toner image has been fixed is outputted via the eject roller 37 outside this image forming apparatus, and then, is stored in the eject tray 38 provided on an upper unit of a main body 1 of this image forming apparatus. As previously explained, the image forming process executed when one sheet of color print is outputted is accomplished.

Next, the photosensitive drum 11, the developing apparatus 14, and the intermediate transfer belt 15 will now be explained in detail.

Figure 2:
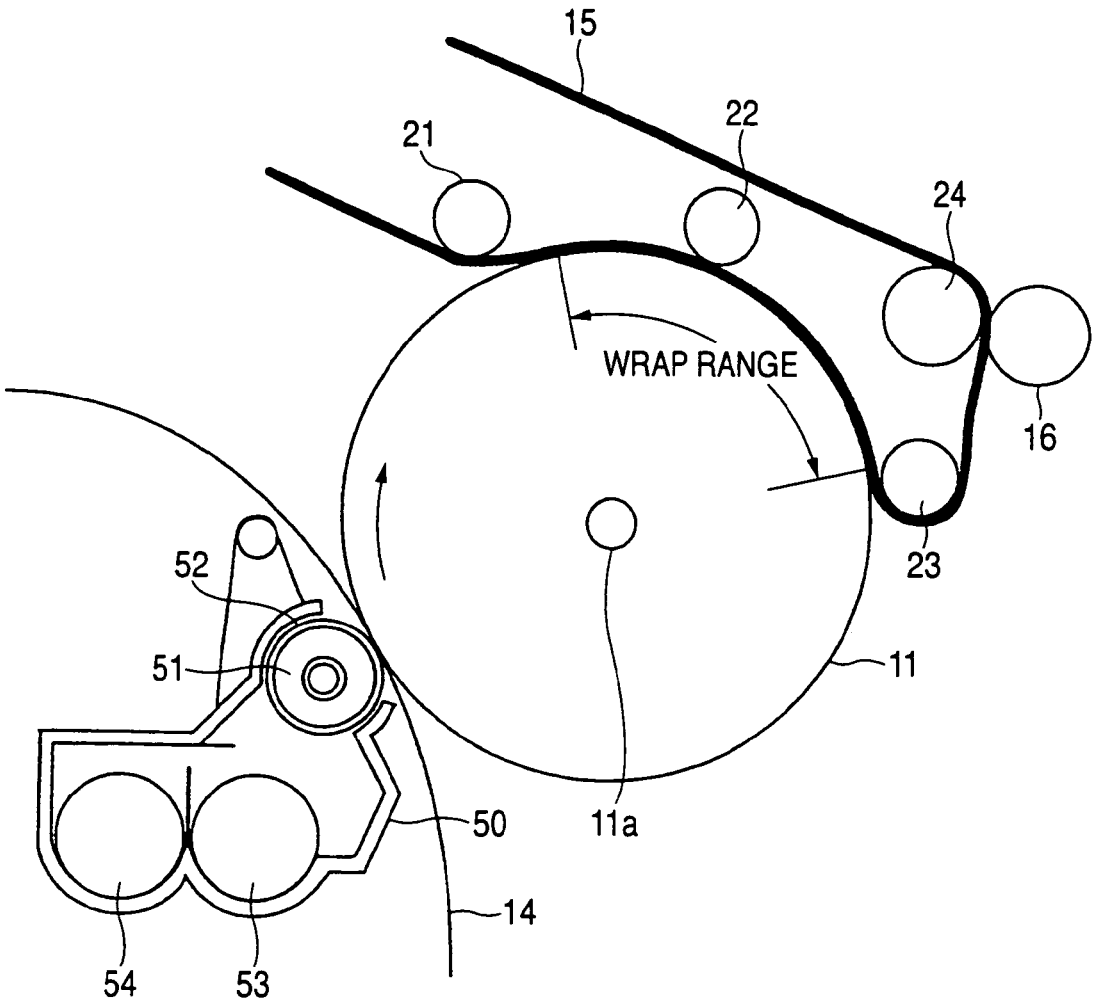
FIG. 2 is an explanatory diagram for explaining a relationship among a photosensitive drum, a developing apparatus, and an intermediate transfer belt.

FIG. 2 is an explanatory diagram for explaining a relationship among the photosensitive drum 11, the developing apparatus 14, and the intermediate transfer belt 15. The photosensitive drum 11 is made of a tube-shaped member having a diameter of approximately 47 mm, and a photosensitive layer is formed on a surface of an aluminum pipe. This photosensitive drum 11 receives drive force of a motor (not shown) from a shaft 11*a* of a center unit thereof via flanges (not shown) made of aluminum, which are provided on both edges of this aluminum pipe. For instance, in such a case that a color image having a length (297 mm) of an A4-paper size along the longitudinal direction is printed out at a speed of 5 sheets (5 ppm) per 1 minute, 20 sheets of images (namely, 4 color images×5 sheets) must be formed within 1 minute on the photosensitive drum 11. The photosensitive drum 11 is arranged in such a manner that this photosensitive drum 11 is rotated 3 turns in order to form one image. In other words, this photosensitive drum 11 is rotated at a speed of approximately 150 mm/sec, 1 turn per 1 second. Also, in order to reduce color shifts which are caused by eccentricity and the like of the photosensitive drum 11, the respective color images are desirably formed at the same place on the photosensitive drum 11.

Each of these developing devices 50 which constitute the developing apparatus 14 is equipped with a developing roller 51, a tracking roller 52, a supply auger 53, and an admix auger 54. The developing roller 51 corresponds to a developing agent carrier which carries a developing agent. The tracking roller 52 corresponds to a positioning member which is used to keep a distance between the developing roller 51 and the photosensitive drum 11 at a constant value. Both the supply anger 53 and the admix anger 54 may stir the developing agent supplied to the developing roller 51. The developing roller 51 is made of a tube-shaped member having a diameter of approximately 16 mm. While carriers contained in the developing agent are absorbed by using magnetic force by way of a magnet roller (not shown) arranged inside this developing roller 51, a magnetic brush of the developing agent is formed on the surface of this developing roller 51, so that the toners absorbed on the carriers may be transported to the developing area of the photosensitive drum 11. Since the magnetic brush formed in this manner performs the developing operation while the brush tip portions are contacted to the surface of the photosensitive drum 11, the distance between the photosensitive drum 11 and the developing roller 51 is always required to keep a certain constant interval.

To this end, the tracking roller 52 whose radius is slightly larger than the radius of the developing roller 51 by approximately 0.3 mm is provided with this developing roller 51 in a coaxial manner at both end units (In-side and Out-side of apparatus, or right side and left side of apparatus) of this developing roller 51. For example, assuming now that the diameter of the developing roller 51 is equal to 16 mm, the diameter of the tracking roller 52 becomes 16.6 mm. As this tracking roller 52, such a tracking roller made of synthetic resin such as polyacetal is employed. This tracking roller 52 is provided with each of the four developing devices 50 arranged in the developing apparatus 14. In the developing apparatus 14, when the developing devices 50 are switched, the desirable developing roller 51 is pivotally rotated at the rotating speed of 90 degrees per 0.7 seconds so as to be located opposite to the photosensitive drum 11. At this time, the tracking roller 52 may abut against the photosensitive drum 11 by being traced over the circumferential unit. Also, this tracking roller 52 is made in contact with the photosensitive drum 11, while shocks may be reduced by receiving predetermined elastic force which produced by the coil spring 55 shown in FIG. 1.

On the other hand, the intermediate transfer belt 15 is made in contact to the photosensitive drum 11 with respect to a wrap range shown in FIG. 2 in such a manner that the photosensitive drum 11 is covered by this intermediate transfer belt 15 in combination with both the wrap-in roller 21 and the wrap-out roller 23. Both the wrap-in roller 21 and the wrap-out roller 23 are not made in contact with the photosensitive drum 11, but can prevent sandwiching of the intermediate transfer belt 15 due to fluctuations and the like as to the photosensitive drum 11, and may suppress damages given to the intermediate transfer belt 15. The wrap range (namely, wrap-shaped contact range) as indicated in FIG. 2 corresponds to such an arc range which is formed by an angle of about 90 degrees at a circumferential portion of the photosensitive drum 11.

Figure 3A:
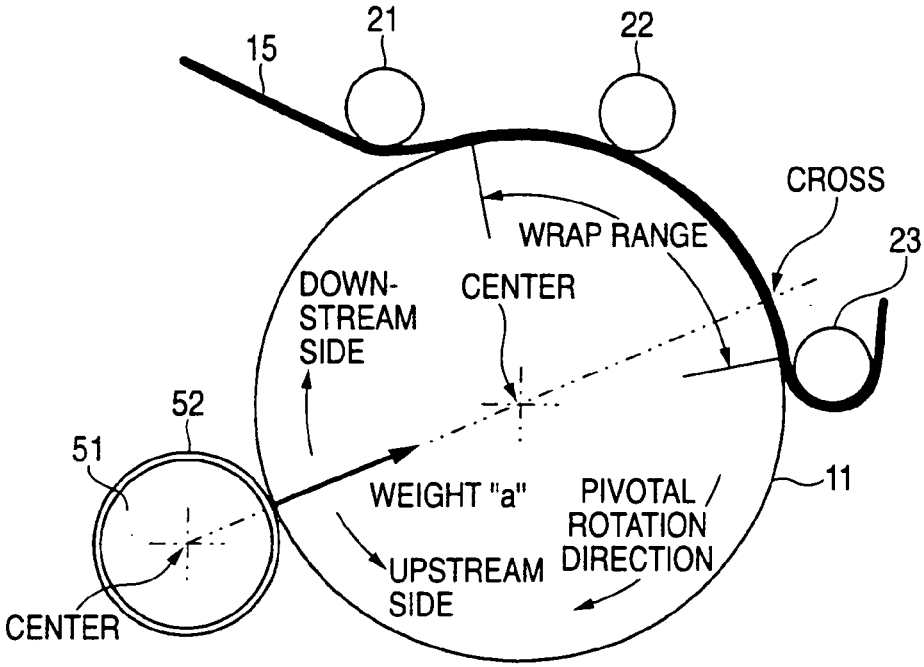
FIGS. 3A and 3B are explanatory diagrams for explaining a weight relationship with respect to the photosensitive drum.
Figure 3B:
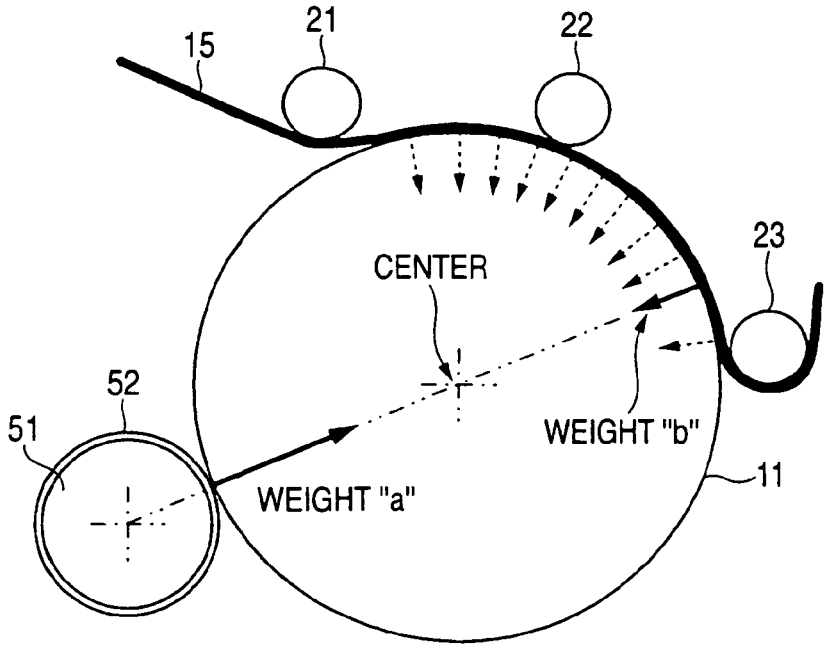

FIG. 3A and FIG. 3B are diagrams for explaining a weight relationship with respect to the photosensitive drum 11. As shown in FIG. 3A, the tracking roller 52 functioning as a first contacting unit is contacted (abuts), and the intermediate transfer belt 15 corresponding to an intermediate transfer member functioning as a second contacting unit is contacted (abuts) with respect to the photosensitive drum 11 corresponding to an image carrier which is pivotally rotated. This intermediate transfer belt 15 is an elastic belt, and depresses the photosensitive drum 11 in relatively strong weight. More specifically, in this embodiment, while no drive force is applied to the intermediate transfer belt 15 itself, since this intermediate transfer belt 15 may be followed by receiving the drive force of the photosensitive drum 11, the contact pressure becomes relatively high. On the other hand, the photosensitive drum 11 is manufactured as a precision component in high precision. However, when this photosensitive drum 11 is manufactured in low cost, there are some cases that plays may be produced between a shaft of this photosensitive drum and bearings, while maximum dimensions of these plays are approximately 0.1 mm. As a result, the photosensitive drum 11 is depressed by receiving weight exerted from the intermediate transfer belt 15, so that the photosensitive drum 11 may be pivotally rotated under such a condition that the pivotal rotation of this photosensitive drum 11 is deviated by plays occurred in the manufacturing stages. Since images formed on the photosensitive drum 11 are disturbed due to the pivotal rotation by this deviation (eccentricity), there is such a risk that an image defect such as color shifts may occur. Also, when depression only along one direction with respect to the photosensitive drum 11 is continuously applied, there is a problem as to holding of the photosensitive, drum 11 in connection with a time elapse and further, other difficulties such as bending of a drum shaft may also occur. In particular, in order to realize low cost and light weight, in such a case that a diameter of a drum shaft of a photosensitive drum is made smaller, and a thickness with respect to a tube-shaped shaft is made thinner, and also a light-weight material is selected, a bending problem of drum shaft may become very important.

As a consequence, in this embodiment, while such a member is employed, the photosensitive drum 11 is arranged in such a manner that this photosensitive drum 11 can be held under stable condition. This member depresses the photosensitive drum along a direction opposite to a weighting direction along which this intermediate transfer belt 15 depresses the photosensitive drum 11, namely from an opposite direction via the drum shaft (namely, center of photosensitive drum 11). As this depressing operation from the opposite direction at this time, abutment of the tracking roller 52 which is coaxially provided with the developing roller 51. It should be understood that while having an opposite sense, the relationship among these structural components may be given as follows. Assuming now that a predetermined direction is determined as the depression direction of the tracking roller 52, an opposite direction corresponds to the depression direction of the intermediate transfer belt 15.

The tracking roller 52 is made in contact to the photosensitive drum 11 at two places, namely, both edge portions of such an area of the photosensitive drum 11 in which no image forming operation is carried out. As weight (namely, weight "a" shown in FIG. 3A and FIG. 3B) given by the tracking roller 52, one set of this tracking rollers 52 is nearly equal to 1 kgf, and two sets of the tracking rollers 52 are nearly equal to 2 kgf. Such a weight given from the opposite side with respect to this weight is applied toward the existing intermediate transfer belt 15, namely this weight is applied toward such a wrap range by the intermediate transfer belt 15, so that disturbances of transferred images caused by shocks and vibrations when the tracking roller 52 abuts against the intermediate transfer belt 15 can be suppressed, and also, the photosensitive drum 11 can be held under stable condition, thus, deviation only along one direction can be prevented. Further, eccentricity of the photosensitive drum 11 can be suppressed.

When this condition is continuously considered, the relationship between these constructions may become further clear. First, as indicated in FIG. 3A, a direction of weight "a" applied from the side of the developing roller 51 is intersected with a wrap-shaped contact range (wrap range) defined by the intermediate transfer belt 15. In other words, the direction of the weight "a" applied from the side of the developing roller 51 may be located within the wrap range. As indicated in FIG. 3A, while having another grasp, an extended line of a line which connects a center of the developing roller 51 to a center of the photosensitive drum 11 maybe located within such a range (namely, wrap range) in which the intermediate transfer belt 15 corresponding to the transferring unit abuts against the circumferential portion of the photosensitive drum 11 in a wrap shape. Since these structural components are arranged in the above-described manner, the weight given from the member which is contacted with respect to the photosensitive drum 11 may be positively utilized, so that this photosensitive drum 11 can be held under stable condition. Furthermore, this wrap range is eccentrically located on the side of the down stream with respect to the pivotally rotation direction of the photosensitive drum 11. As will be explained, for example, even in such a case that weight is produced with having a predetermined trail from the upper stream direction of the pivotally rotation direction of the photosensitive drum 11, the weight relationship can be maintained without producing extra moment.

Also, FIG. 3B represents such a condition of weight under which the intermediate transfer belt 15 corresponding to the intermediate transfer member may give an influence to the photosensitive drum 11 corresponding to the image carrier. For the sake of simple consideration, when dynamic weight is omitted, a plurality of weight are present from abutting positions within the wrap range shown in FIG. 3A toward the central direction of the photosensitive drum 11. Among these plural weight, a direction of at least one weight, namely weight "b" may constitute a substantially straight line with respect to a straight line which connects a contact point of the tracking roller 52 to the center of the photosensitive drum 11. Since such a weight "b" is present, disturbances of images with respect to the photosensitive drum 11 may be suppressed and the occurrence of the unnecessary moment with respect to the photosensitive drum 11 can be prevented.

Figure 4:
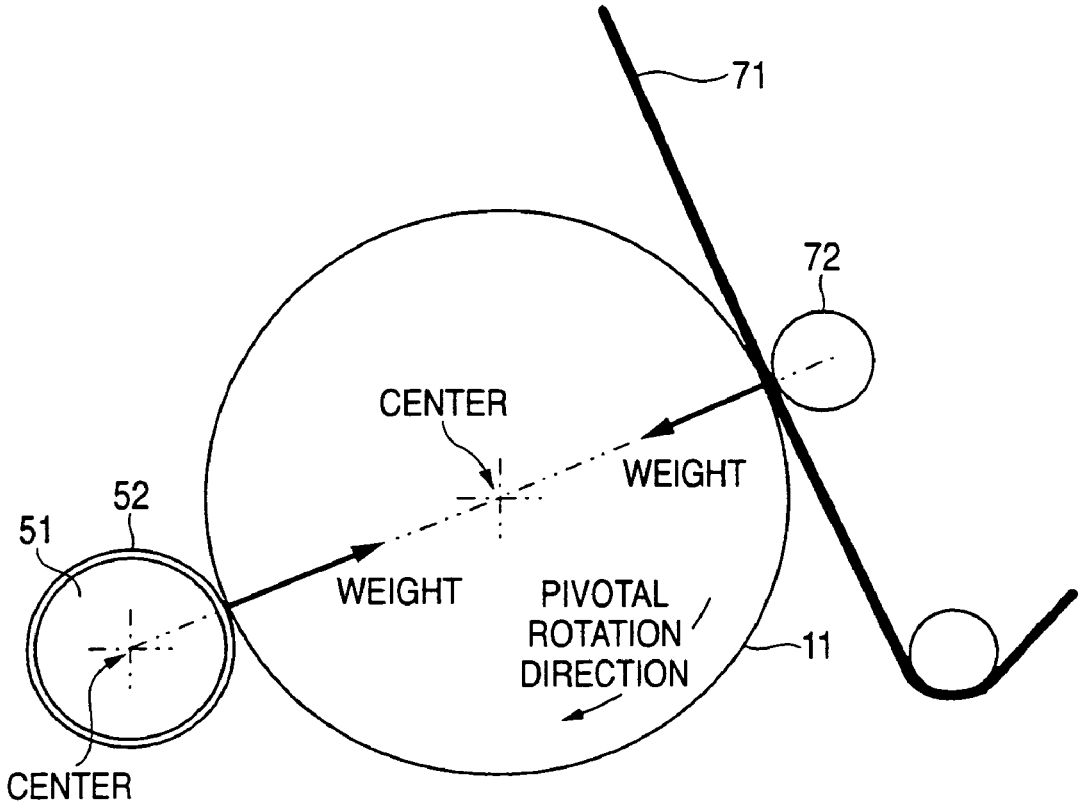
FIG. 4 is a diagram for indicating a modification according to the embodiment.

FIG. 4 is a diagram for indicating a modification according to this embodiment. When these considerations are furthermore progressed, in the case that a portion of the developing device 50 abuts against a portion of the photosensitive drum 11, even an image forming apparatus in which a so-called "wrap transfer" operation is not carried out may be alternatively arranged in such a way that eccentricity of the photosensitive drum can be suppressed. For instance, in the modification of FIG. 4, while an intermediate transfer belt 71 is made in contact with the photosensitive drum 11 not in the above-explained wrap transfer, but in a straight-line manner, the intermediate transfer belt 71 is depressed from a rear side (namely inside of intermediate transfer belt 71) of this contact point by employing a primary transfer roller 72. In this case, the modification shown in FIG. 4 owns such a portion that both a weight direction by the tracking roller 52 of the developing device 50 with respect to the photosensitive drum 11 and another weight direction by the intermediate transfer belt 71 (and primary transfer belt 72) with respect to the photosensitive drum 11 may constitute a substantially straight line. In other words, the weight direction by the tracking roller 52 with respect to the photosensitive drum 11 is made substantially coincident with an abutting place between the intermediate transfer belt 71 and the photosensitive drum 11. Furthermore, in other words, the image forming apparatus of this modification contains such a portion that a center of the developing roller 51 (center of tracking roller 52), a center of the photosensitive drum 11, and a contact point between the intermediate transfer belt 71 and the photosensitive drum 11 may become a substantially straight line. As previously explained, even in such a case that the intermediate transfer belt 71 does not abut against the photosensitive drum 11 in the wrap shape, since the inventive idea according to this embodiment is extended, it maybe possible to suppress an occurrence of unnecessary moment with respect to the photosensitive drum 11.

Next, a description will now be made of a trail made when the tracking roller 52 abuts against the photosensitive drum 11.

Figure 5:
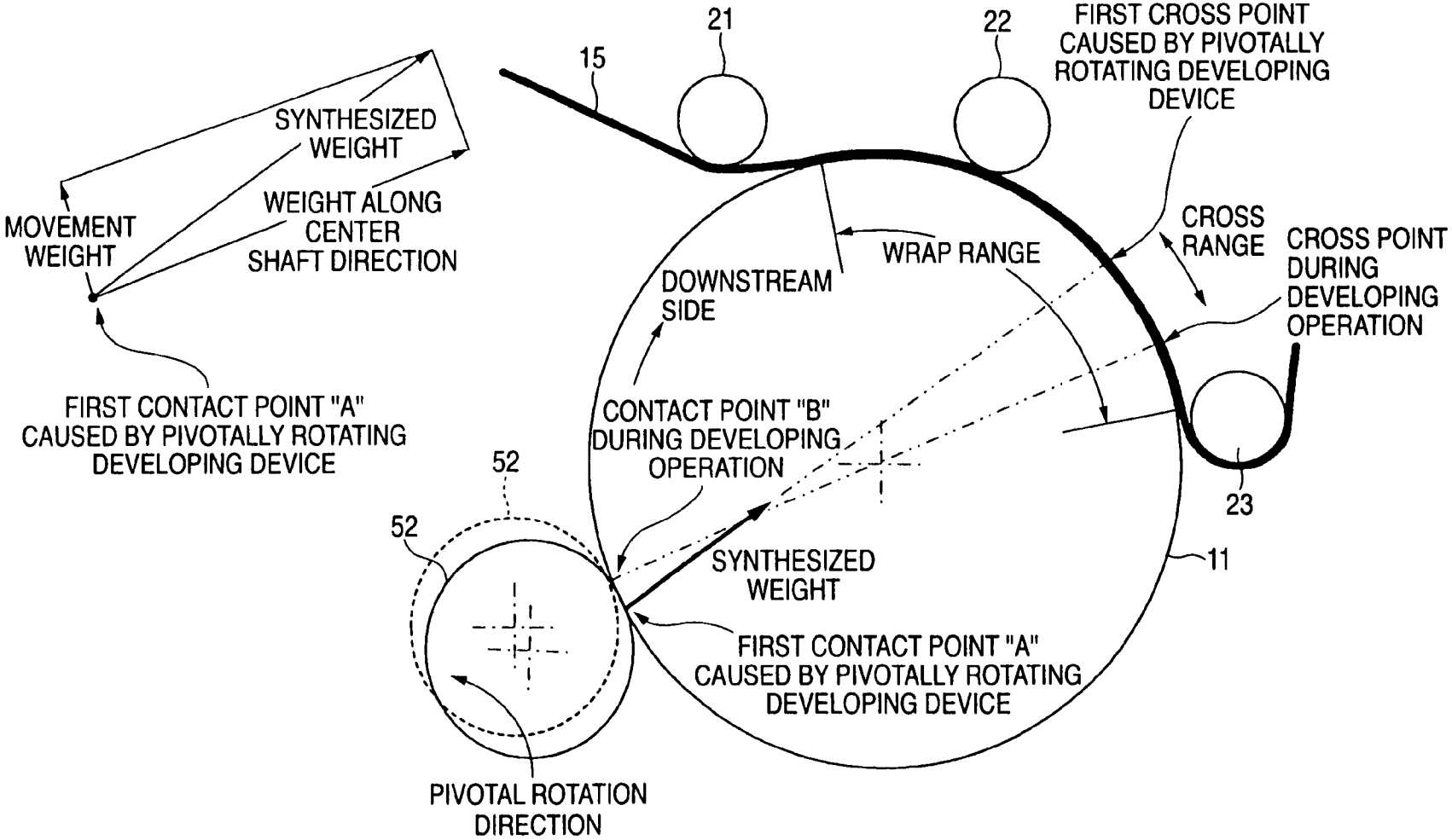
FIG. 5 is an explanatory diagram for explaining changes in weight directions caused by pivotal rotations of a developing device.

FIG. 5 is a diagram for explaining a change in weight directions, which is caused by pivotal rotations of the developing device 50. FIG. 5 represents a relationship among the photosensitive drum 11, the developing apparatus 14, and the intermediate transfer belt 15, and includes an explanatory diagram for explaining synthesized weight which is obtained when the tracking roller 52 is firstly contacted to the photosensitive drum 11 since the developing device 50 is pivotally rotated. As explained with reference to FIG. 1, since the developing apparatus 14 is pivotally rotated every rotation angle of 90 degrees around the developing apparatus center 14*a* as the center, the developing roller 51 provided in the desirable developing devices 50 is located opposite to the photosensitive drum 11. At this time, as shown in FIG. 5, the tracking roller 52 which is coaxially provided with the developing roller 51 is made in contact with the photosensitive drum 11 at a first contact point "A" since the developing apparatus 14 (developing 50) is pivotally rotated. As previously explained with reference to FIG. 1. In the developing apparatus 14, the coil spring 55 is employed in each of the four color developing devices 50, and the relevant developing device 50 is depressed by the coil spring 55 thereof along the tangential direction.

As represented in FIG. 5, the following abstraction may be considered. That is, while both weight along a center axial direction produced by this coil spring 55 and movement weight (namely, weight along tangential direction over circumference in developing apparatus 14) produced in connection with the pivotal rotation of the developing device 50 are exerted to the first contact point "A" due to the pivotal rotation of the developing device 50, the weight produced by synthesizing the weight along the center axial direction with the weight along the tangential direction is exerted to the photosensitive drum 11. This synthesized weight corresponds to a vector of the synthesized weight. At this time, as indicated in FIG. 5, in this embodiment, an extension line along the direction of this synthesized weight is also entered into the wrap range. Thereafter, a cross point is also moved due to a trail of the tracking roller 52, and then, becomes a cross point during the developing operation. Since the image forming apparatus is arranged in such a way that this cross range entirely belongs to the wrap range, such a problem may be solved. That is, the central axis of the photosensitive drum 11 is shifted by the eccentric weight which is produced by pivotally rotating the developing device 50 with respect to the photosensitive drum 11.

In order to reduce shocks with respect to the photosensitive drum 11 in this embodiment, the image forming apparatus is arranged in such a manner that the rotation direction of the developing apparatus 14 is directed to a forward direction (namely, rotation direction itself is counter-clockwise direction, i.e., reverse direction) at a contact portion between this developing apparatus 14 and the photosensitive drum 11. In this case, the movement weight due to the pivotal rotation of the developing device 50 is produced at the contact portion along the forward direction. In this case, there is such a trend that the direction of the weight (synthesized weight) produced by the abutting member such as the tracking roller 52 is broadened to the downstream side rather than the cross point during the developing device 50. As a result, if the wrap range broadened to the down stream side is formed by the intermediate transfer belt 15, then the shocks caused by the trail of the abutting member can be reduced. When the developing apparatus 14 is pivotally rotated along the reverse direction, it is so effective to broaden the wrap range also on the upstream side.

When a further investigation is made, the adverse influence caused by the pivotal rotation of the developing apparatus 14 may also occur in such a case that the photosensitive drum 11 is separated from the contact point "B" during the developing operation. In other words, after the developing operation is ended, since the developing device 50 is pivotally rotated in order to replace the present developing device by the next developing device, the tracking roller 52 is pivotally rotated from the position of the contact point "B" during the developing operation shown in FIG. 5 along the counter-clockwise direction shown in this drawing. It is preferable that a vector direction of such a weight is directed to the wrap range, while this weight is obtained by synthesizing dynamic weight produced in connection with this pivotal rotation of the tracking roller 52 with another weight produced by that the tracking roller 52 depresses the photosensitive drum 11 by the coil spring 55. While the tracking roller 52 is separated from the photosensitive drum 11 by such a predetermined trail, if it is so featured that the direction along which the tracking roller 52 depresses the photosensitive drum 11 due to this trail is located within such a range (wrap range) that the intermediate transfer belt 15 abuts against the circumferential portion of the photosensitive drum 11 in the wrap shape, then such a problem caused by eccentric weight produced when the tracking roller 52 is separated from the photosensitive drum 11 can be reduced.

Figure 6:
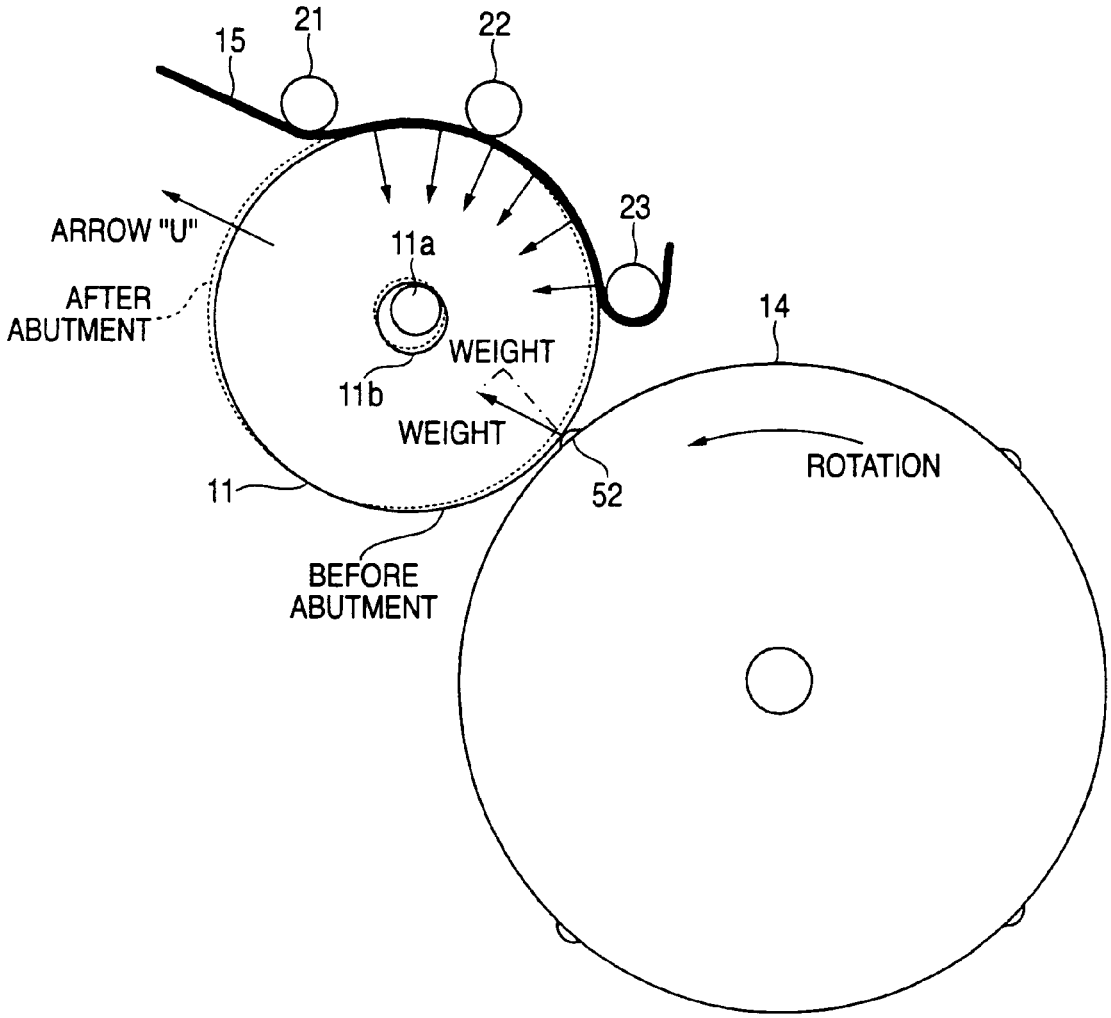
FIG. 6 is a diagram for indicating a comparison example in the embodiment.

FIG. 6 shows a comparison example in this embodiment, namely, a direction of weight given to the photosensitive drum 11 by the tracking roller 52 does not intersect a range (wrap range) in which the intermediate transfer belt 15 abuts with respect to a circumferential portion of the photosensitive drum 11. FIG. 6 represents such a relationship between the shaft 11*a* of the photosensitive drum 11 and a hole 11*b* of this photosensitive drum 11. For the sake of an easy explanation, a dimensional error between the shaft 11*a* and the hole 11*b* of this photosensitive drum 11 is relatively extremely emphasized. Before the tracking roller 52 abuts against the photosensitive drum 11, the photosensitive drum 11 is present at such a position indicated by a solid line of FIG. 6 due to weight given from the intermediate transfer belt 15, which is exerted on the photosensitive drum 11. At this time, the photosensitive drum 11 is brought into such a condition that this photosensitive drum 11 is eccentrically positioned along a predetermined direction because of dimensional errors owned by the respective shaft 11*a* and hole 11*b*.

Thereafter, when the tracking roller 52 abuts against the photosensitive drum 11 at such a weight as shown in FIG. 6 due to the pivotal rotation of the developing apparatus 14, this photosensitive drum 11 is moved to a position as indicated by a broken line of FIG. 6. In this example shown in FIG. 6, a direction along which the intermediate transfer belt 15 depresses the photosensitive drum 11 is largely different from a direction along which the tracking roller 52 depresses the photosensitive drum 11. As a result, the photosensitive drum 11 may be easily shifted along a direction as indicated by, for example, an arrow "U" of FIG. 6. In particular, in such a case that the dimensional errors contained the shaft 11*a* and the hole 11*b* are large, shift amounts become very large. Also, depending upon the direction of this arrow "U", there are some cases that shocks produced when the tracking roller 52 abuts against the photosensitive drum 11 may become large vibrations. In other words, in such a comparison example shown in FIG. 6, while the vibration of the photosensitive drum 11 is increased in connection with the shocks produced when the tracking roller 52 abuts against the photosensitive drum 11, this large vibration may appear as disturbances of an image. On the other hand, in this embodiment, since the direction along which the intermediate transfer belt 15 depresses the photosensitive drum 11 is directed opposite to the direction along which the tracking roller 52 depresses the photosensitive drum 11, such a vibration produced by the shocks when the tracking roller 52 abuts against the photosensitive drum 11 can be reduced, so that disturbances of the image can be suppressed.

As previously explained in detail, the image forming apparatus, according to one embodiment of the present invention, is so arranged by employing: the pivotally rotated photosensitive drum 11; the developing roller 51 for developing the electrostatic latent image formed on this photosensitive drum 11; and the intermediate transfer belt 15 for temporarily holding the toner image which has been developed to be formed by the developing roller 51. This developing roller 51 is equipped with the tracking roller 52 which abuts against the photosensitive drum 11 so as to keep the distance between the developing roller 51 and the photosensitive drum 11 as a constant distance. The direction of the weight "a" produced by this tracking roller 52 with respect to the photosensitive drum 11 may be positioned within the wrap range corresponding to the abutting range between the intermediate transfer belt 15 and the photosensitive drum 11. As a result, when the tracking roller 52 corresponding to the abutting member abuts against the photosensitive drum 11, disturbances of the images caused by the shocks and vibrations thereof can be reduced. Also, since the relationship between the abutting condition of the tracking roller 52 with respect to the photosensitive drum 11 and the abutting condition of the intermediate transfer belt 15 with respect to the photosensitive drum 11 is determined based upon the above-explained relationship, the photosensitive drum 11 may be held under stable condition, and eccentricity caused by the weight given to the photosensitive drum 11 maybe suppressed. Otherwise, the occurrence of unnecessary moment maybe suppressed, so that the disturbances of the image can be reduced. Also, the plays of the bearings which are provided at the shaft of the photosensitive drum 11 may be suppressed It should be understood that this embodiment has explained that the photosensitive drum 11 has been exemplified as the image carrier. Similarly, the present invention may be applied to such a case that a belt-shaped member may be employed as the image carrier. In the case that the present invention is applied to such a belt-shaped photosensitive member, shocks and vibrations with respect to rollers which support this photosensitive belt may be reduced, and also, eccentric loads may be decreased. Also, as the developing apparatus 14, the rotary type developing apparatus has been exemplified. Alternatively, the present invention may be applied to such a developing apparatus other than the rotary type developing apparatus, namely, a developing apparatus which is contacted to the photosensitive drum 11 by way of predetermined weight. Even when, for instance, a developing apparatus 14 for forming a single color image is employed, in such a case that there is a function by which a preselected member abuts against the photosensitive drum 11 as a reason of predetermined positioning, problems in which weight produced by these members during abutment is given to the photosensitive drum 11 may be mitigated by employing the above-described technique.

As previously described, in accordance with the image forming apparatus of the preset invention, even when the member which abuts with respect to the image carrier is employed, the disturbances of the images produced while these images are formed can be suppressed.

What is claimed is:

1. An image forming apparatus comprising:

a first contacting unit including a positioning member that contacts an image carrier and exerts a force on the image carrier in a direction that is normal to the first contacting unit and the image carrier; and a second contacting unit that contacts the image carrier in a wrap shape, wherein the normal direction intersects the wrap-shaped contact range.

2. The image forming apparatus according to claim 1, wherein the second contacting unit is provided on the downstream side of a pivotal rotation direction of the image carrier with respect to the first contacting unit.

3. The image forming apparatus according to claim 1, wherein the first contacting unit is a member capable of maintaining a distance between the image carrier and a developing agent carrier for developing a latent image formed on the image carrier.

4. The image forming apparatus according to claim 3, wherein the first contacting unit is provided in a developing device in which a plurality of the developing agent carriers are provided on a circumference thereof, and the positioning member is a tracking member capable of maintaining the distance between a specific developing agent carrier and the image carrier when the developing device is pivotally rotated and thus the specific developing agent carrier is located opposite to the image carrier.

5. The image forming apparatus according to claim 1, wherein the second contacting unit is an elastic belt which is followed by receiving driving force produced from the image carrier.

6. The image forming apparatus according to claim 5, wherein the second contacting unit is contacted to the image carrier under predetermined depression force.

7. The image forming apparatus according to claim 1, wherein the second contacting unit is an intermediate transfer member which temporarily holds thereon a toner image formed on the image carrier by a developing agent carrier.

8. An image forming apparatus comprising:

an image carrier;

a developing device for developing an electrostatic latent image formed on the image carrier; and an intermediate transfer member for abutting against the image carrier so as to temporarily hold thereon a toner image formed by being developed by the developing device, wherein the developing device is comprised of a positioning member which abuts against the image carrier and exerts a force on the image carrier in a direction that intersects an abutting range between the intermediate transfer member and the image carrier.

9. The image forming apparatus according to claim 8, wherein the intermediate transfer member is made of an elastic belt, and abuts with respect to the image carrier under such a condition that the image carrier is wrapped only over a predetermined range by the intermediate transfer member.

10. The image forming apparatus according to claim 9, wherein the intermediate transfer member is followed by receiving driving force produced from the image carrier.

11. The image forming apparatus as claimed in claim 8, wherein the developing device holds a plurality of developing agent carriers along a circumferential direction thereof, and is pivotally rotated in such a manner that a desirable developing agent carrier among the plural developing agent carriers is transported to a developing position located opposite to the image carrier.

12. The image forming apparatus according to claim 11, wherein the positioning member employed in the developing device is a tracking member capable of maintaining an interval between each of the developing agent carriers and the image carrier in a constant value.

13. The image forming apparatus according to claim 8, wherein the image carrier is a photosensitive drum having an axial center.

14. An image forming apparatus comprising:

an image carrier;

a developing device for developing an electrostatic latent image formed on the image carrier, and that contacts the image carrier by a positioning member; and an intermediate transfer member that contacts the image carrier and holds thereon a toner image which has been developed to be formed by the developing device, wherein the positioning member exerts a force on the image carrier in a direction through a contact point of the intermediate transfer member with the image carrier, and through a center of the image carrier.

15. The image forming apparatus according to claim 14, wherein an eccentricity of the image carrier is suppressed by both the intermediate transfer member and the developing device.

16. The image forming apparatus according to claim 14, wherein the intermediate transfer member is made of an elastic belt, and is contacted to the image carrier via either a line or a plane.

17. The image forming apparatus according to claim 14, wherein the developing device is contacted to the image carrier at a preselected portion in order to keep a distance of a portion of the developing device located opposite to the image carrier constant.

18. The image forming apparatus according to claim 17, wherein the developing device is contacted to the image carrier at a non-image forming portion, and contacted toward a substantially center direction of the image carrier in predetermined weight.

19. An image forming apparatus comprising:

an electrostatic latent image forming unit for forming an electrostatic latent image on an image carrier;

a developing unit in which a plurality of developing rollers are provided along a circumferential direction thereof in order to develop the electrostatic latent image formed by the electrostatic latent image forming unit to thereby form a toner image, and a desirable developing roller is transported to a developing position located opposite to the image carrier; and a transferring unit which abuts against the image carrier in a wrap shape, and temporarily holds thereon the toner image formed on the image carrier, wherein an extension of a line which connects a center of the image carrier to a center of the desirable developing roller located opposite to the image carrier is positioned within a range where the transferring unit abuts against the image carrier in a wrap shape; and wherein the developing unit employs a member capable of maintaining an interval between the developing roller and the image carrier in a constant value in correspondence with each of the developing rollers.

20. The image forming apparatus according to claim 19, wherein the member employed in the developing unit depresses the image carrier along a predetermined direction when positioning of the developing roller for executing the developing operation is carried out with respect to the image carrier.

21. An image forming apparatus comprising:

an electrostatic latent image forming unit for forming an electrostatic latent image on an image carrier;

a developing unit in which a plurality of developing agent carriers are provided along a circumferential direction thereof in order to develop the electrostatic latent image formed by the electrostatic latent image forming unit to thereby form a toner image, and a desirable developing agent carrier is pivotally rotated to a developing position located opposite to the image carrier; and a transferring unit which abuts against the image carrier in a wrap shape, and temporarily holds thereon the toner image formed on the image carrier, wherein in the developing unit, when the desirable developing agent carrier is pivotally rotated to the developing position, a predetermined member abuts against the image carrier and exerts a force on the image carrier in a direction that intersects a range where the transferring unit abuts against the image carrier in the wrap shape.

22. The image forming apparatus according to claim 21, wherein the predetermined member is a tracking roller which abuts against the image carrier within a non-developing range, and determines an interval between the image carrier and the developing agent carrier.

23. The image forming apparatus according to claim 21, wherein the predetermined member is provided in correspondence with all of the developing agent carriers provided in the developing unit; and when each of the developing agent carriers is located opposite to the image carrier, a direction along which the predetermined member depresses against the image carrier is located within the range where the transferring unit abuts against the image carrier in the wrap shape.

24. An image forming apparatus comprising:

an electrostatic latent image forming unit for forming an electrostatic latent image on an image carrier;

a developing unit in which a plurality of developing agent carriers are provided along a circumferential direction thereof in order to develop the electrostatic latent image formed by the electrostatic latent image forming unit to thereby form a toner image, and a desirable developing agent carrier is pivotally rotated to a developing position located opposite to the image carrier; and a transferring unit which abuts against the image carrier in a wrap shape, and temporarily holds thereon the toner image formed on the image carrier, wherein in the developing unit, when the desirable developing agent carrier is separated from the developing position, a predetermined member is separated from the image carrier along a line that intersects a range where the transferring unit abuts against the image carrier in a wrap shape.

25. A method of holding an image carrier comprising the steps of:

abutting a positioning member with respect to a pivotally rotated image carrier in a predetermined direction through a center shaft of the image carrier so as to depress the image carrier;

depressing the image carrier via the center shaft of the image carrier with a force in a direction opposite to the predetermined direction; and stably holding the image carrier based upon both the depression made in the predetermined direction and the depression made in the direction opposite to the predetermined direction.

26. The image carrier holding method according to claim 25, wherein the depression along the predetermined direction is realized by abutting with respect to the image carrier from a circumferential portion of the image carrier in a wrap shape within a predetermined range so as to depress the image carrier.

27. The image carrier holding method according to claim 26, wherein the opposite direction corresponds to such a direction along which the depression is made from the circumferential portion toward the center shaft within a range at the circumferential portion of the image carrier, which is formed by an extension of such a straight line passing through the abutting range in the wrap shape and the center shaft.

* * * * *